US011913441B2

(12) United States Patent
Miller et al.

(10) Patent No.: US 11,913,441 B2
(45) Date of Patent: Feb. 27, 2024

(54) AIR COMPRESSOR SYSTEM HAVING A HOLLOW PISTON FORMING AN INTERIOR SPACE AND A CHECK VALVE IN A PISTON CROWN ALLOWING AIR TO EXIT THE INTERIOR SPACE

(71) Applicant: Transportation IP Holdings, LLC, Norwalk, CT (US)

(72) Inventors: Andrew Miller, Wilmerding, PA (US); Christopher Lucke, Wilmerding, PA (US); Jeffrey Hritz, Wilmerding, PA (US); Matthew Chatham, Wilmerding, PA (US); Wesley Martincic, Wilmerding, PA (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 28 days.

(21) Appl. No.: 17/646,447

(22) Filed: Dec. 29, 2021

(65) Prior Publication Data

US 2023/0204022 A1 Jun. 29, 2023

(51) Int. Cl.

| | |
|---|---|
| ***F04B 39/16*** | (2006.01) |
| ***F04B 37/12*** | (2006.01) |
| ***F04B 39/00*** | (2006.01) |
| ***F04B 39/10*** | (2006.01) |

(52) U.S. Cl.

CPC ..... *F04B 39/16* (2013.01); *F04B 37/12* (2013.01); *F04B 39/0022* (2013.01); *F04B 39/0094* (2013.01); *F04B 39/10* (2013.01)

(58) Field of Classification Search

CPC ..... F04B 39/16; F04B 37/12; F04B 39/0022; F04B 39/0094; F04B 39/10; F04B 39/001; F04B 53/12; F04B 27/02; F04B 39/0005; F04B 5/02; F04B 27/053; F04B 25/005; F02B 75/24; F01L 11/02

USPC ..... 417/314, 404, 534, 60, 261, 439

See application file for complete search history.

(56) References Cited

U.S. PATENT DOCUMENTS

| | | | | |
|---|---|---|---|---|
| 46,219 A * | 2/1865 | Dennisson | F04B 49/225 | 417/314 |
| 299,314 A * | 5/1884 | Allen | F04B 47/04 | 74/44 |
| 1,333,774 A * | 3/1920 | Pedersen | F04B 39/0016 | 417/261 |
| 1,523,790 A * | 1/1925 | Pedersen | B60S 5/04 | 92/138 |
| 2,169,565 A * | 8/1939 | Maniscalco | F04B 27/005 | 92/138 |
| 2,169,571 A * | 8/1939 | Maniscalco | F04B 27/02 | 92/138 |
| 2,256,926 A * | 9/1941 | Maniscalco | F04B 25/005 | 92/138 |

(Continued)

*Primary Examiner* — Essama Omgba
*Assistant Examiner* — Benjamin Doyle
(74) *Attorney, Agent, or Firm* — McCoy Russell LLP

(57) ABSTRACT

Systems are provided for an air compressor system. In one example, a system includes a housing, a piston arranged in the housing, and a crankshaft arranged in the housing, the crankshaft coupled to a connecting rod of the piston, and the crankshaft forces the piston to oscillate from a first end of the housing to a second end, the piston pressurizing air in the housing to a first pressure at the first end and to a second pressure at the second end, the second pressure greater than the first.

18 Claims, 15 Drawing Sheets

(56) References Cited

U.S. PATENT DOCUMENTS 2,323,068 A * 6/1943 Maniscalco ..... F04B 25/005 417/261
2,403,814 A * 7/1946 Maniscalco ..... F04B 39/00 417/261
3,456,874 A * 7/1969 Graper ..... F04B 39/0261 417/571
T883,011 I4 * 2/1971 Miller ..... F04B 39/0016 417/259
3,694,109 A * 9/1972 Walls ..... F04B 39/08 417/510
3,834,840 A * 9/1974 Hartley ..... F04B 39/00 417/535
4,072,210 A * 2/1978 Chien ..... F04B 39/0016 184/5
4,132,510 A * 1/1979 Takahashi ..... B26D 7/086 92/255
4,138,972 A * 2/1979 Wilson ..... F02M 59/20 123/495
4,373,876 A * 2/1983 Nemoto ..... F01B 1/08 417/539
4,485,768 A * 12/1984 Heniges ..... F02B 75/04 123/197.1
4,492,127 A * 1/1985 Kuhn ..... F04B 35/04 417/415
4,529,365 A * 7/1985 Schutt ..... F04B 39/066 417/372
4,961,405 A * 10/1990 Dorsch ..... F02F 1/34 417/372
4,995,795 A * 2/1991 Hetzel ..... F04B 39/0027 417/571
5,137,434 A * 8/1992 Wheeler ..... F04B 39/066 417/415
5,171,135 A * 12/1992 Gannaway ..... F04B 39/0016 251/64
5,286,282 A * 2/1994 Goodell ..... B60T 17/004 96/147
5,431,130 A * 7/1995 Brackett ..... F01B 9/047 123/197.2
5,525,044 A * 6/1996 Chen ..... F04B 5/02 417/262
5,879,145 A * 3/1999 Baumgartner ..... F04B 39/126 417/524
6,357,235 B1 * 3/2002 Cerro ..... F04B 9/105 60/645
7,428,886 B1 * 9/2008 Minculescu ..... F02B 33/14 123/62
7,475,627 B2 * 1/2009 Irick ..... F02B 75/32 92/138
10,859,075 B2 * 12/2020 Bredbeck ..... F04B 53/14
11,028,923 B2 * 6/2021 Kamp ..... F16J 1/001
2004/0228737 A1 * 11/2004 Folchert ..... F04B 25/02 417/415
2007/0130987 A1 * 6/2007 Shimizu ..... F25D 23/006 62/507
2007/0251379 A1 * 11/2007 Lund ..... F04B 39/0016 92/172
2009/0068040 A1 * 3/2009 Mann ..... F04B 25/005 417/521
2012/0192710 A1 * 8/2012 Moore ..... F04B 39/121 92/12.2
2012/0227708 A1 * 9/2012 Jones ..... F01L 1/46 123/47 A
2013/0287611 A1 * 10/2013 Schmidt ..... F04B 17/04 417/443
2022/0235750 A1 * 7/2022 Todman ..... F04B 27/005

* cited by examiner

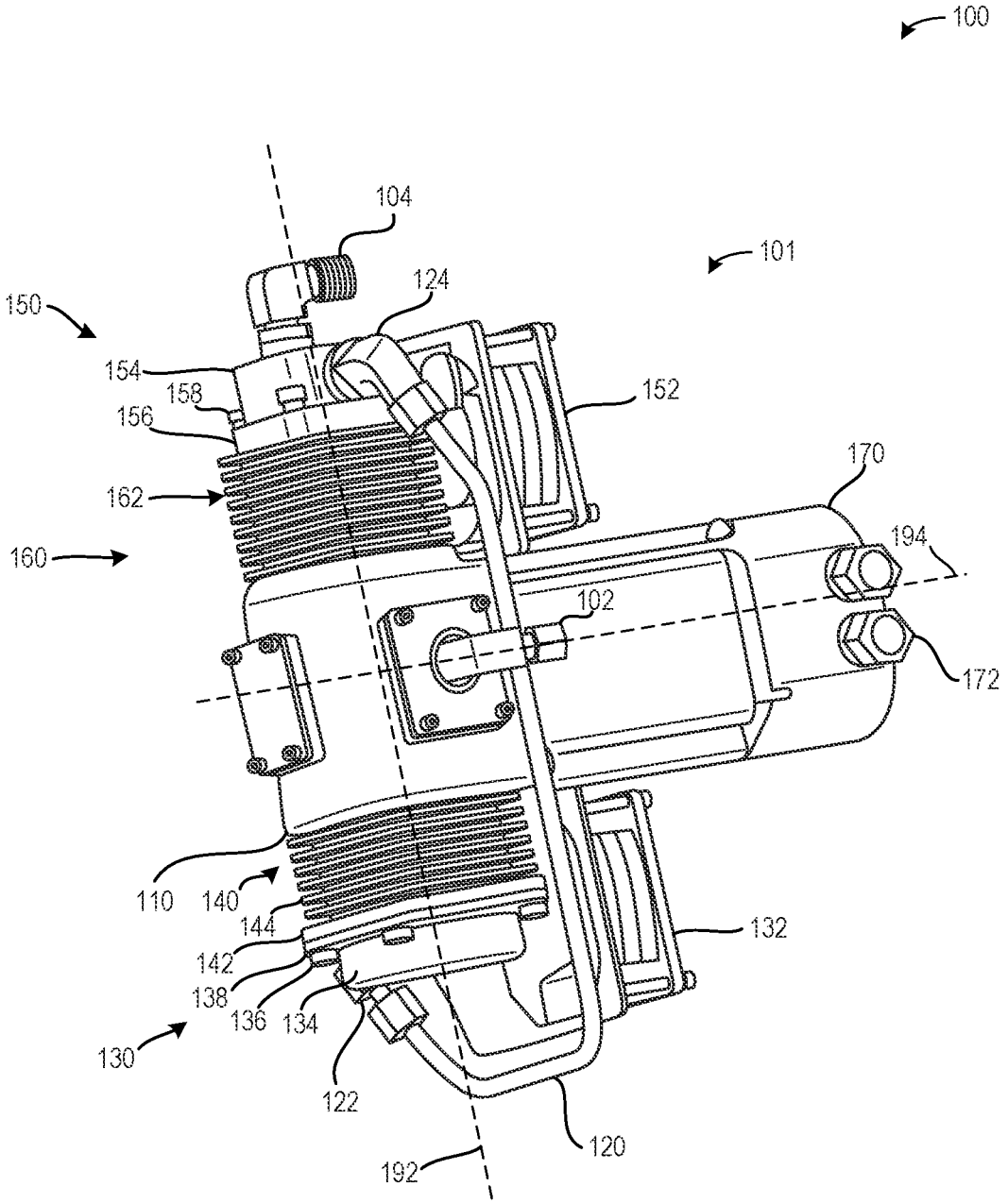
FIG. 1
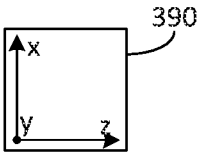

AIR COMPRESSOR SYSTEM HAVING A HOLLOW PISTON FORMING AN INTERIOR SPACE AND A CHECK VALVE IN A PISTON CROWN ALLOWING AIR TO EXIT THE INTERIOR SPACE

BACKGROUND

Technical Field

Embodiments of the subject matter disclosed herein relate to air compressors and air dryers.

Discussion of Art

Air compressor systems may be used on board vehicles for providing compressed air for one or more vehicle applications, e.g., air brake applications, HVAC, and so on. Some vehicle systems have size/dimensional constraints, such that there is limited space on board the vehicle for the air compressor and related equipment, e.g., air dryers. Some air compressors may be provided for fitting into such limited spaces by virtue of having features or components that enable a smaller-sized configuration as the expense of performance aspects, e.g., a lower reliability level, a lower compressed air capacity, and so on.

It may be desirable to provide an air compressor for a vehicle that differs from existing air compressors, including achieving relatively high compressed air capacities and reliability levels in a small package.

BRIEF DESCRIPTION

In one embodiment, an air compressor system includes a housing, a piston arranged in the housing, and a crankshaft arranged in the housing. The crankshaft is coupled to a connecting rod of the piston, and the crankshaft forces the piston to oscillate from a first end of the housing to a second end, the piston pressurizing air in the housing to a first pressure at the first end and to a second pressure at the second end, the second pressure greater than the first.

In an embodiment, an air compressor system includes a compressor and a dryer. The compressor flows pressurized air to the dryer. The compressor includes a piston that oscillates between a first stage and a second stage of the compressor. The air compressor system includes a crankshaft physically coupled to a connecting rod arranged in an interior space of the piston. The interior space receives air from an interior volume of the compressor via a plurality of openings.

In an embodiment, a system includes an air system that can pressurize and dry air flowing therethrough. The air system includes a compressor with a piston. The piston expels air through a check valve arranged in a piston crown to a first stage of the compressor. A second stage of the compressor is fluidly coupled to the first stage via a passage, the second stage of the compressor flows compressed air to an air dryer comprising a shuttle valve integrally arranged therein.

BRIEF DESCRIPTION OF THE DRAWINGS

FIG. 1 shows an example embodiment of the air compressor.

FIGS. 1 to 15B are shown approximately to scale, however, other dimensions may be used.

DETAILED DESCRIPTION

Figure 2:
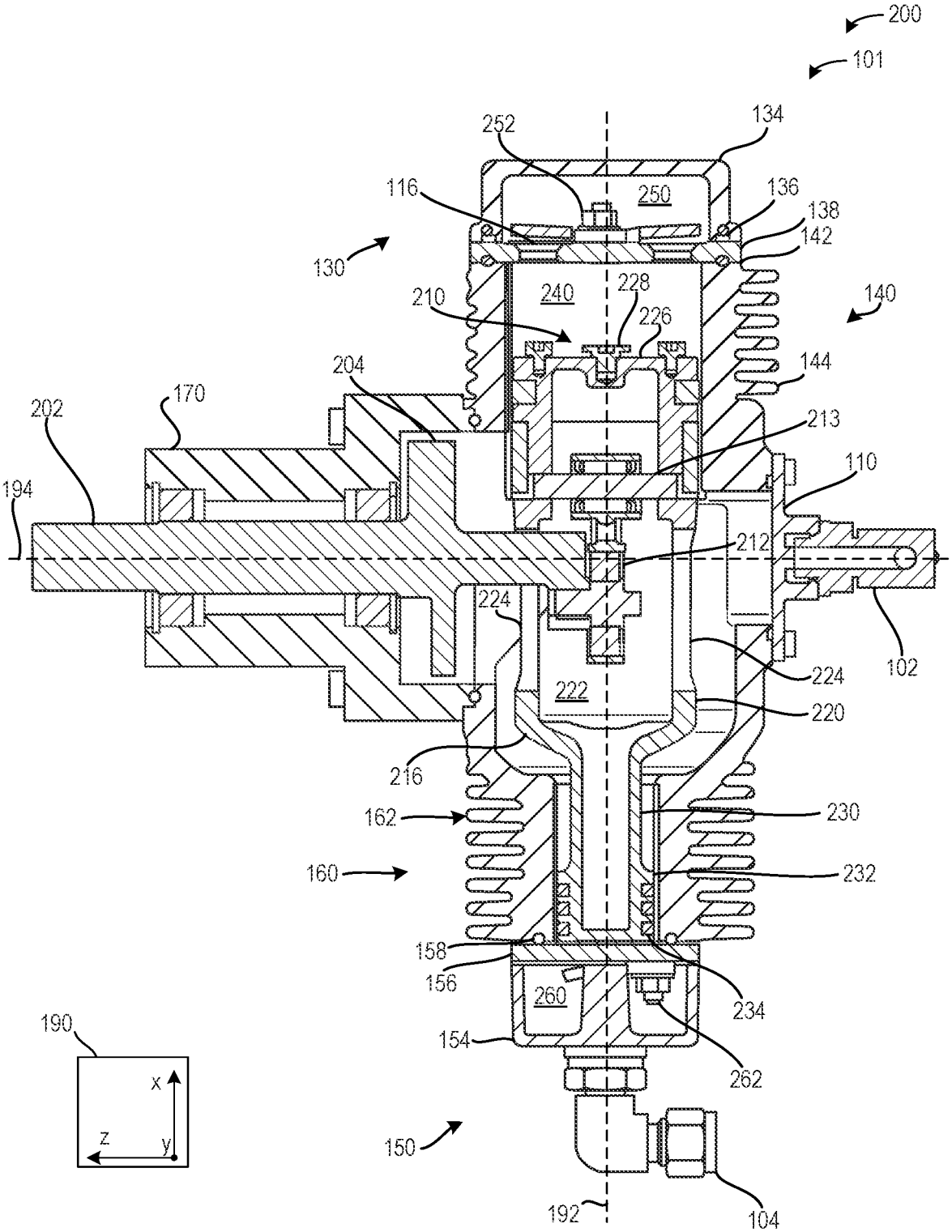
FIGS. 2 and 3 show an internal view of the air compressor.

The following description relates to systems for an air compressor system. The air compressor system may include a housing. A piston and a crankshaft may be arranged within the housing. The crankshaft may include an adapter coupled to a connecting rod which translates rotational motion of the crankshaft to linear motion of the piston. The connecting rod may be arranged within an interior space of the piston. The interior space is defined by surfaces of the piston. The piston may oscillate between a first end of the air compressor system and a second end of the air compressor system. Air may be compressed to a first pressure at the first end by the piston. Air may flow to the second end via a passage and compressed to a second pressure via the piston.

The air pressurized to the second pressure may flow to an air dryer. The air dryer may reduce a moisture content of the air prior to expelling air therefrom. The air dryer may self-regenerate such that a portion of air dried therein may be used to dry desiccants or other drying materials of the air dryer.

A packaging size of the compressor and the air dryer may be reduced via a configuration of the piston of the compressor and a shuttle valve being integrally arranged in the dryer. The piston includes a shape that allows it to fit within a compact space while still compressing air to a threshold pressure. The piston may include features that flow air to its interior volume, which may decrease a manufacturing cost and packaging size by reducing a number of air passages machined into the compressor.

The shuttle valve of the air dryer may be integrally arranged in a head of the air dryer. The shuttle valve may actuate from a first position to a second position, or vice-versa, to allow a first chamber of the air dryer to regenerate as a second chamber of the air dryer dries compressed air from the compressor. The dried, compressed air is fed to an air passage which may be fed to one or more devices (e.g., on board a vehicle or otherwise) that use the dried, compressed air for one or more designated functions, e.g., air brakes, air horns, etc.

Turning now to FIG. 1, it shows an embodiment 100 of a compressor 101 included in a compressed air system. In one example, the compressor may compress air in a two-stage manner. A first stage compresses the air to a first pressure and a second stage compresses the air to a second pressure higher than the first pressure. The compressor is described in greater detail herein.

The compressor includes an inlet 102 coupled to a mid-section 110. The inlet may include an L-shape or other shape where a bend is arranged in a body of the inlet. In one example, the inlet is bent to decrease a packaging size of the compressor. That is to say, by bending the inlet, a profile of the compressor may be reduced. Additionally or alternatively, the inlet may be free of a bend. The inlet may receive ambient air from an ambient atmosphere. In one example, the ambient air is unfiltered. In some examples the ambient air may pass through a filter arranged in the first passage to remove particulates and other compounds suspended in the air.

The mid-section is arranged between a first stage 130 and a second stage 150. The first stage is arranged at a first end of the compressor and the second stage is arranged at a second end of the compressor. The second end is opposite the first end. In one example, compressed air is expelled through an outlet 104 arranged at the second end. A first central axis 192 extends through centers of each of the second stage, the mid-section, and the first stage.

A first fan 132 may be arranged adjacent to the first stage. The first fan may provide thermal management to the first stage. Additionally or alternatively, the first fan may cool the first stage during relatively high ambient temperatures. In one example, the first fan directs an air flow in a direction normal to the first central axis.

The first stage may include a first end cap 134. The first end cap may include a cylindrical shape and may define an extreme end of the first side of the compressor. A first stage main body 140 may include a plurality of fasteners 136 that may physically couple the first end cap to the first stage main body. The first end cap may include a first end cap mating surface 138 which is in face-sharing contact with a first stage main body mating surface 142. The plurality of fasteners may extend through through-holes of the mating surfaces to physically couple the mating surfaces together. In one example, an engagement between the mating surfaces hermetically seals the first stage. In one example, one or more of the through-holes of the first end cap mating surface and the first stage main body mating surface may be threaded. The first end cap mating surface and the first stage main body mating surface may include similar shapes with rounded corners of the mating surfaces. Suitable shapes may include square shapes, ovoid shapes and round shapes.

The first stage main body may include a plurality of fins 144. A suitable fin may extend from the first stage main body, and may increase an overall surface area available. Heat generated during operation of the compressor may dissipate via the plurality of fins. In one example, a fin of the plurality of fins includes a shape similar to the first stage main body mating surface. In some examples, a size of the fin, which includes a thickness and a diameter, may be smaller than a size of the first stage main body mating surface. In other embodiments, the size of the fin may be about equal to the size of the first stage main body mating surface. In one embodiment, each of the plurality of fins may be uniformly spaced apart from one another. In another embodiment, the fins may be staggered relative to each and/or may be offset or spaced with non-uniform widths or with repeating patterns of spacings. The surface finish of a fin may be selected to control an amount of drag (pressure drop) across its surface—with smooth finishes allowing for faster fluid flow and rough or textured surfaces allowing for surface turbulence and longer contact time. The angle of the fins may be selected relative to a direction of fluid flow using principles similar to the surface finish. During operation, the plurality of fins may conduct heat from the first stage main body and may provide a relatively increased surface area to increase dissipation of heat generated therein.

A passage 120 extends from the first stage to the second stage. The passage includes an inlet 122 fluidly coupled to the first stage through which a compressed gas may flow through the inlet and into the passage. The compressed gas may then exit the passage via an outlet 124 fluidly coupled to the second stage. A suitable compressed gas may include air, refrigerant, and gaseous hydrocarbons.

The second stage includes a second fan 152 that may direct a cooling flow to a second end cap 154 and a second stage main body 160. The second fan may operate independently of the first fan such that thermal management of the first stage and the second stage may be executed based on individual cooling demands. The second end cap may include a cylindrical shape similar to the first end cap. The second end cap includes a second end cap mating surface 156, which mates the second end cap to the second stage main body. A plurality of fasteners 158 may physically couple the second end cap to the second stage main body by extending through through-holes of the second end cap mating surface and the second stage main body.

The second stage main body includes a plurality of fins 162, which may be similar to the plurality of fins of the first stage in function. However, in one example, a size of each fin of the plurality fins of the second stage may be smaller than the size of each fin of the plurality of fins of the first stage. Additionally or alternatively, a number of fins of the plurality of fins of the second stage may differ from the number of fins of the plurality of fins of the first stage. In one example, a length of the first stage main body is less than a length of the second stage main body, where the length is measured along the x axis. Additionally, a width of the first stage main body may be greater than a width of the second stage main body, where the width is measured along the z-axis.

In one embodiment, the first stage may be wider and shorter than the second stage. Thus, the second stage is longer and narrower than the first stage. The first stage corresponds to a first compression pressure and the second stage corresponds to a second compression pressure, which is greater than the first compression pressure. For this reason, the thermal management demands of the second stage may be greater than the first stage, leading to the inclusion of a greater number of fins in the second stage than the first stage. By including fewer fins in the first stage, a manufacturing cost, complexity and size of the air compressor system may be controlled. Fin selection parameters may account for additional operational aspects, such as clogging potential, cleaning ease, erosion and corrosion tolerance, and the like.

Figure 5:
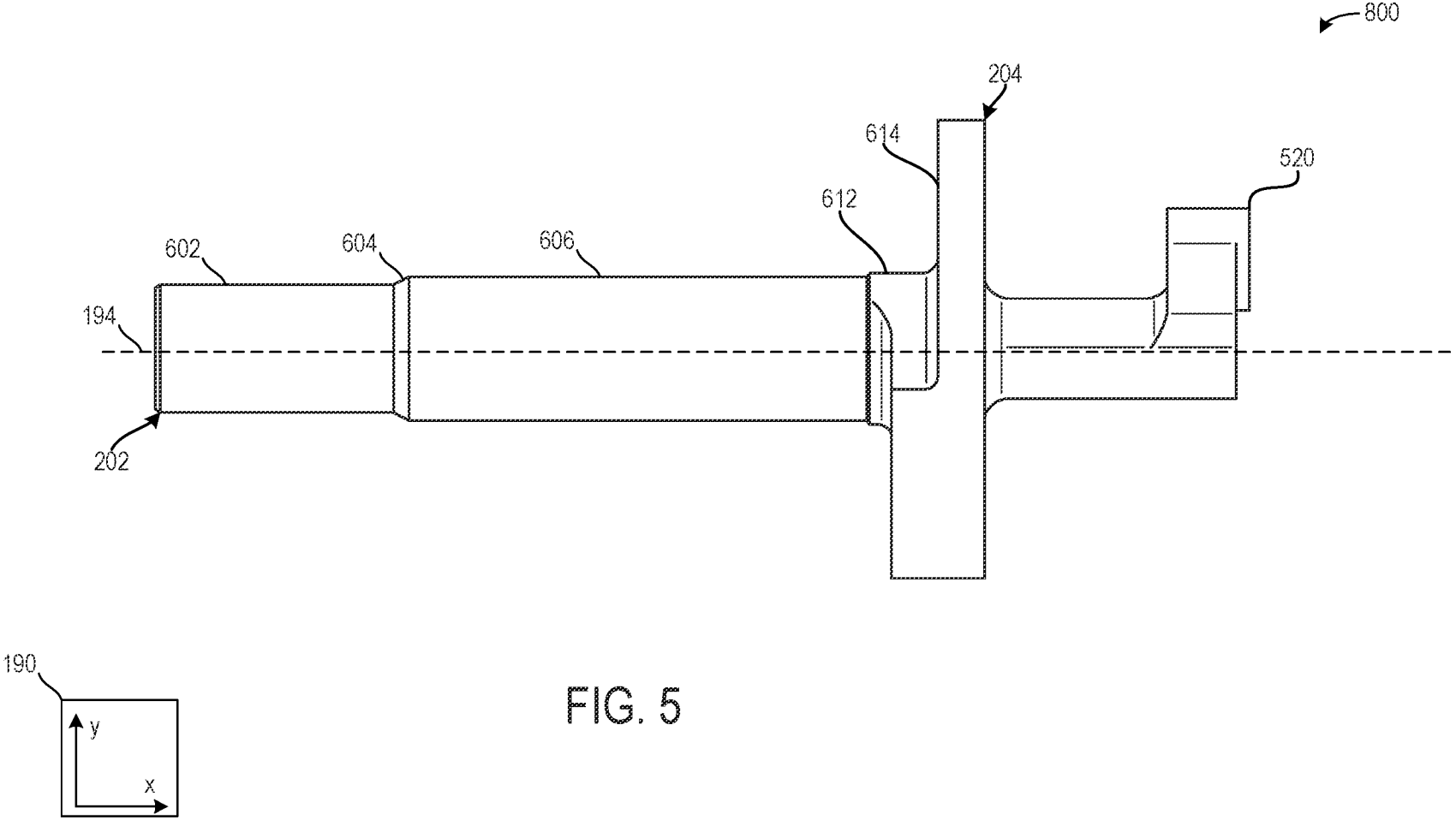
FIGS. 5 and 6 show a detailed view of a shaft of the air compressor.
Figure 6:
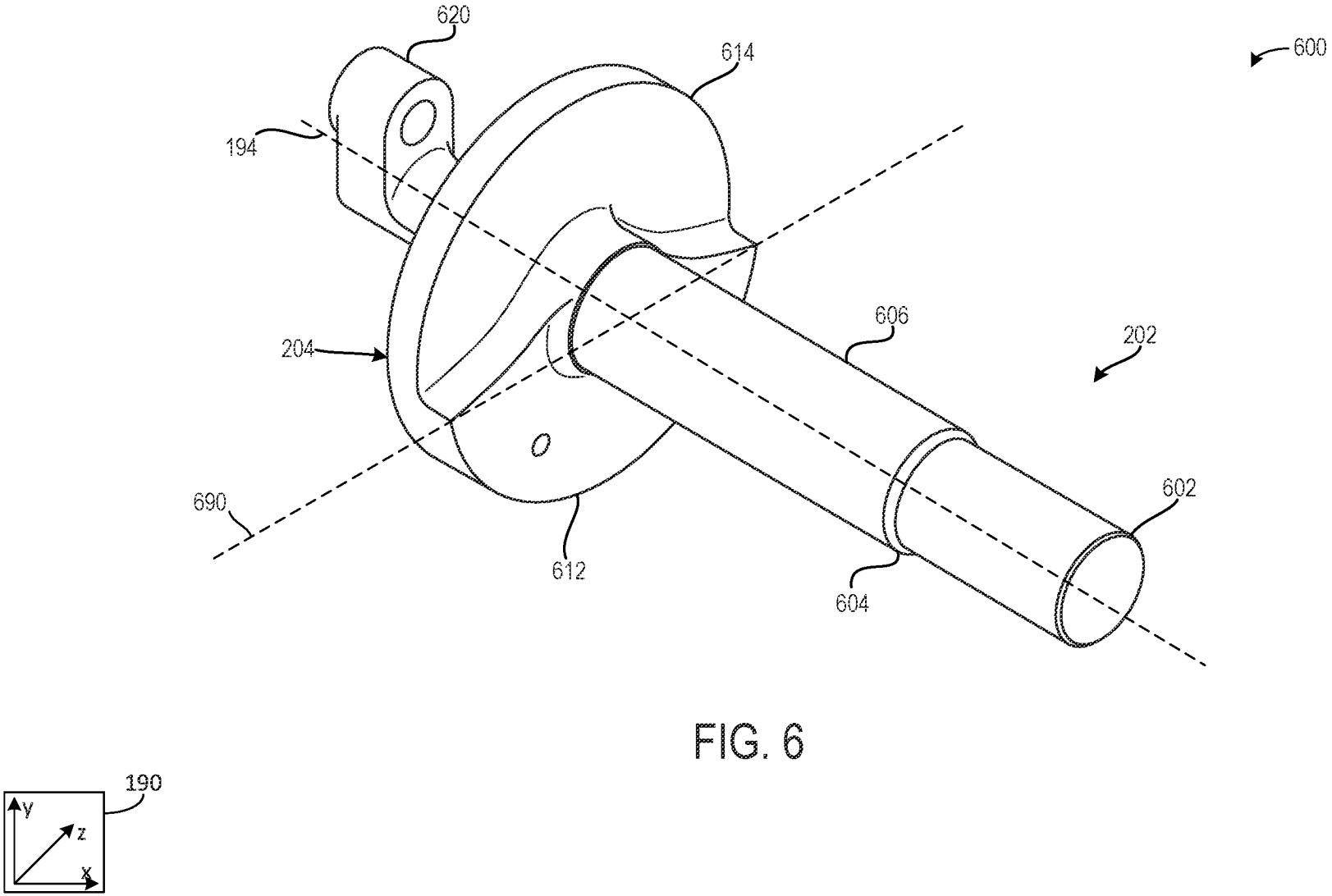
Figure 7:
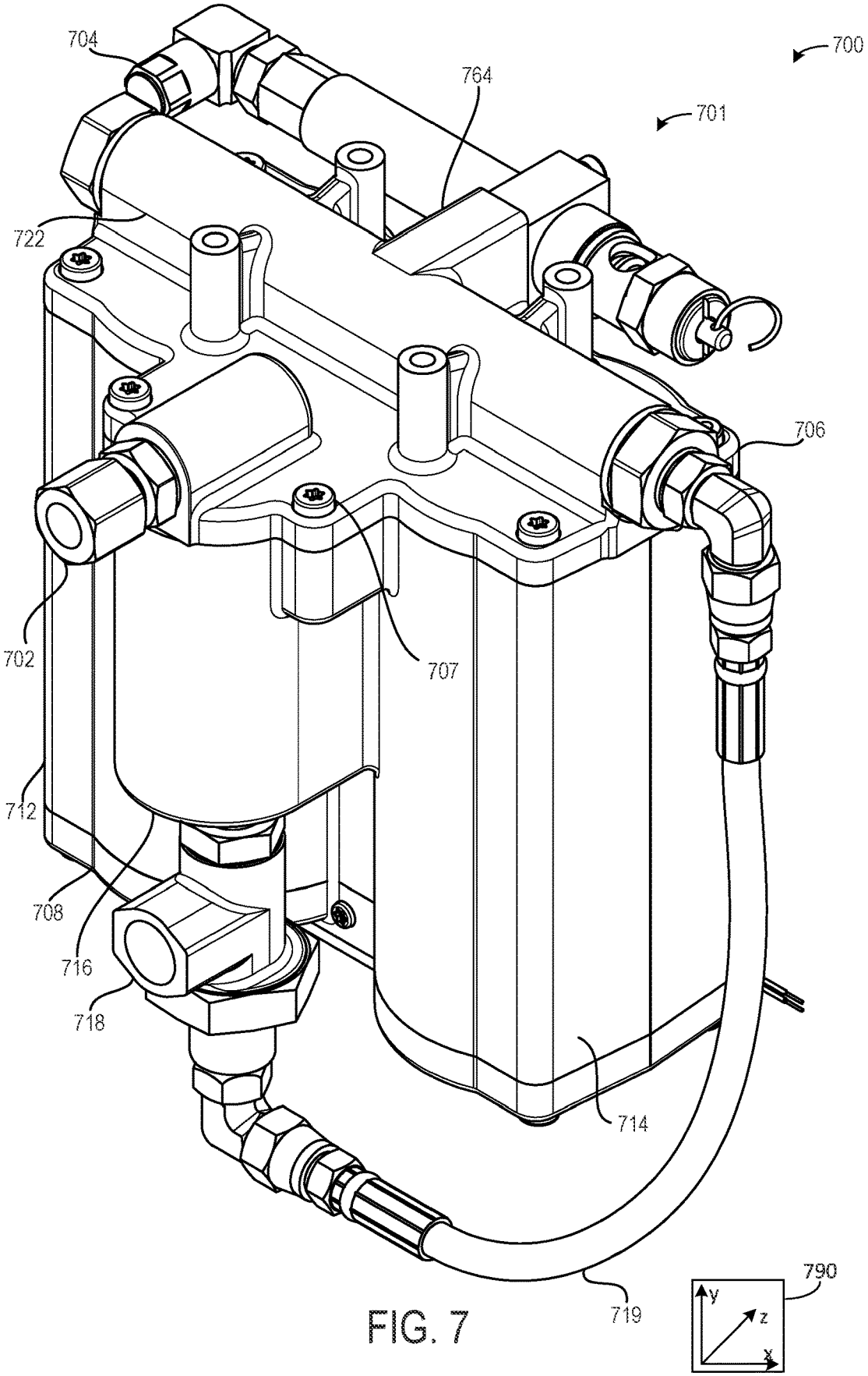
FIG. 7 shows a perspective view of an air dryer.
Figure 8:
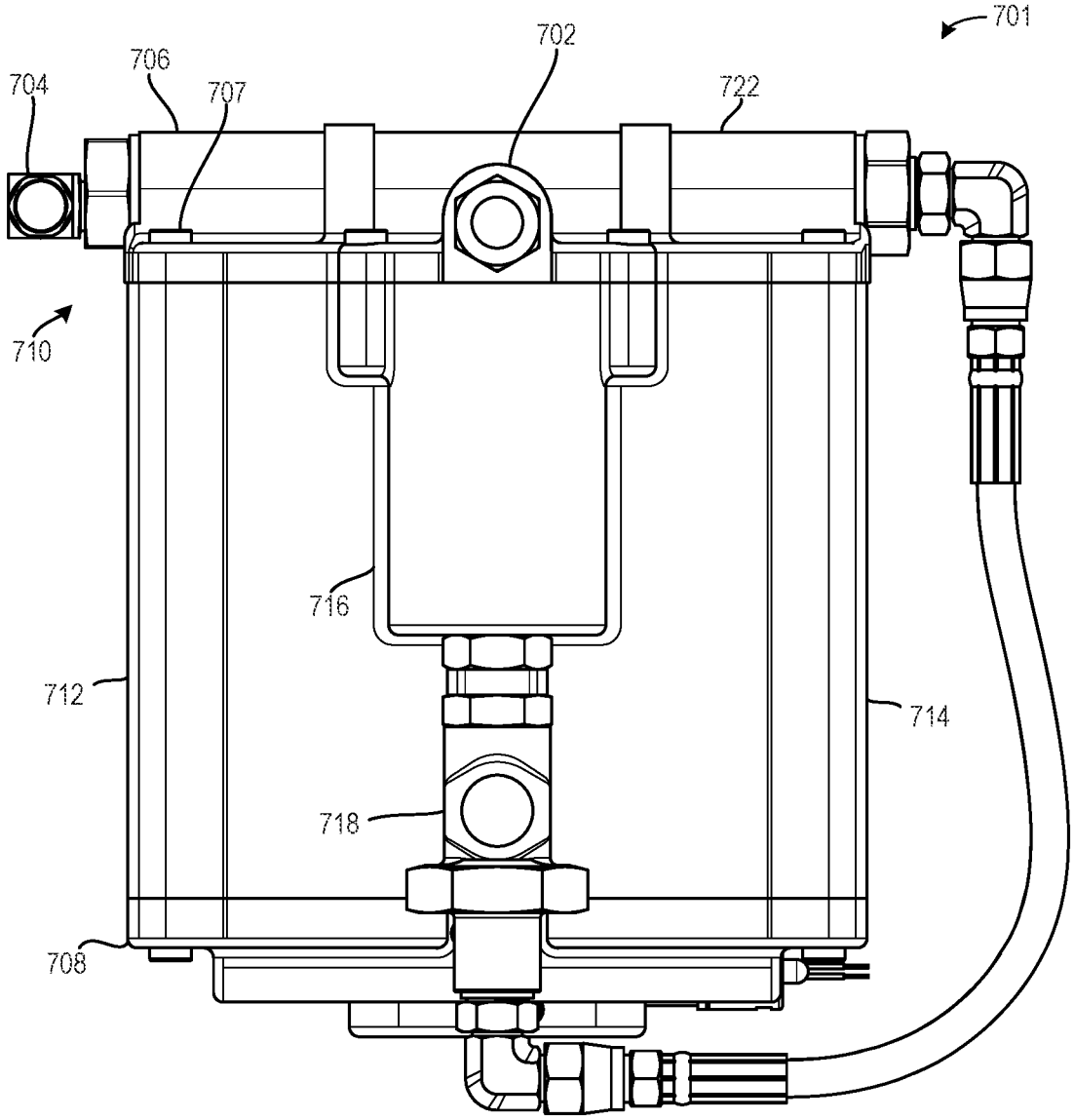
FIG. 8 shows a face-on view of the air dryer.
Figure 9:
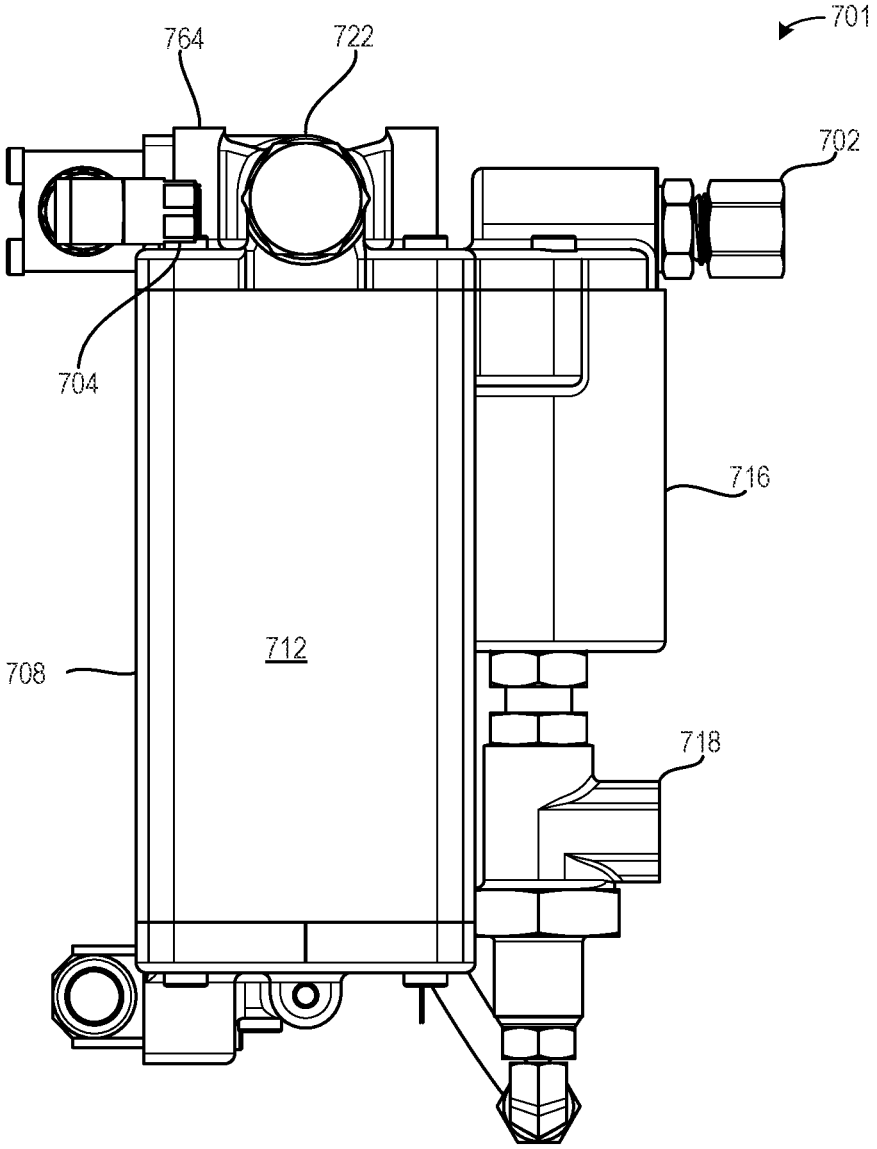
FIG. 9 shows a first side-on view of the air dryer.
Figure 10:
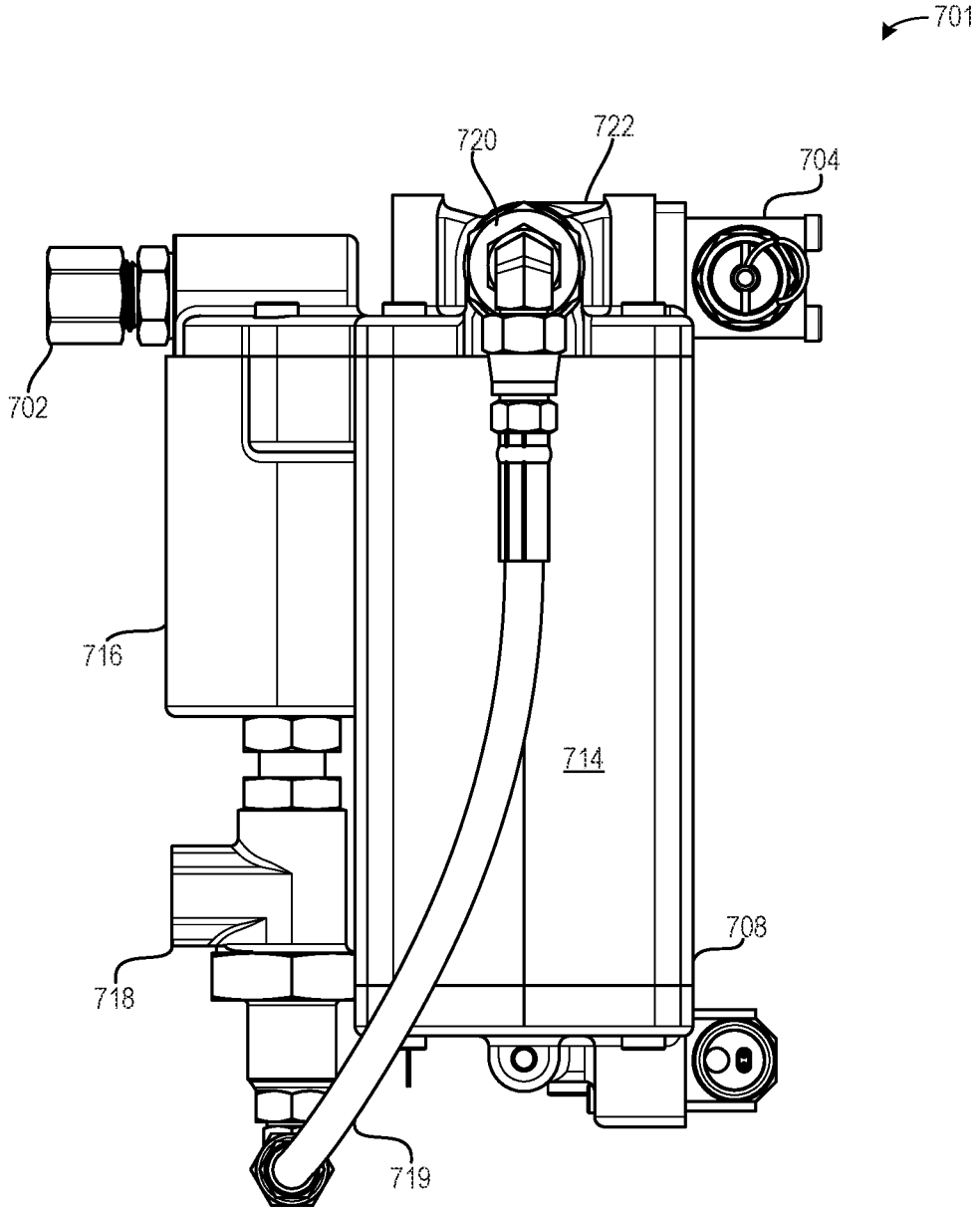
FIG. 10 shows a second side-on view of the air dryer.
Figure 11:
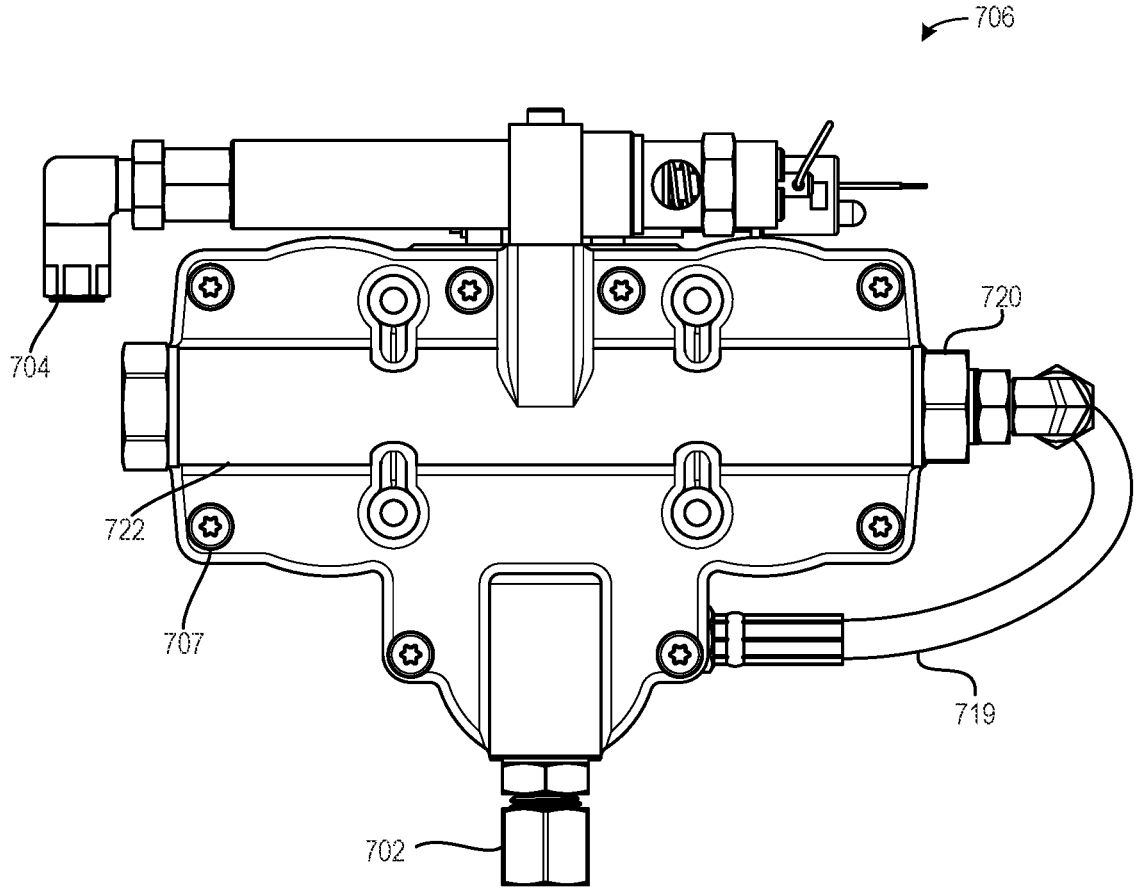
FIG. 11 shows a top-down view of the air dryer.
Figure 12:
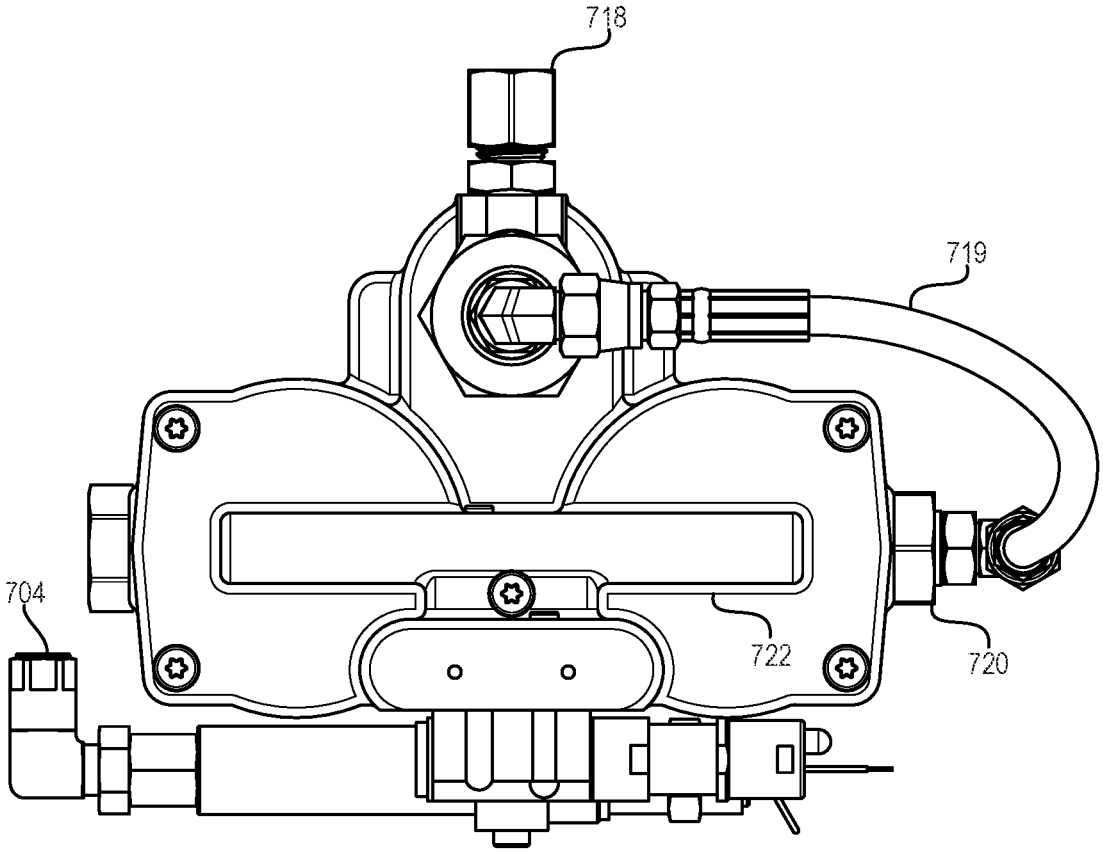
FIG. 12 shows a bottom-up view of the air dryer.
Figure 13:
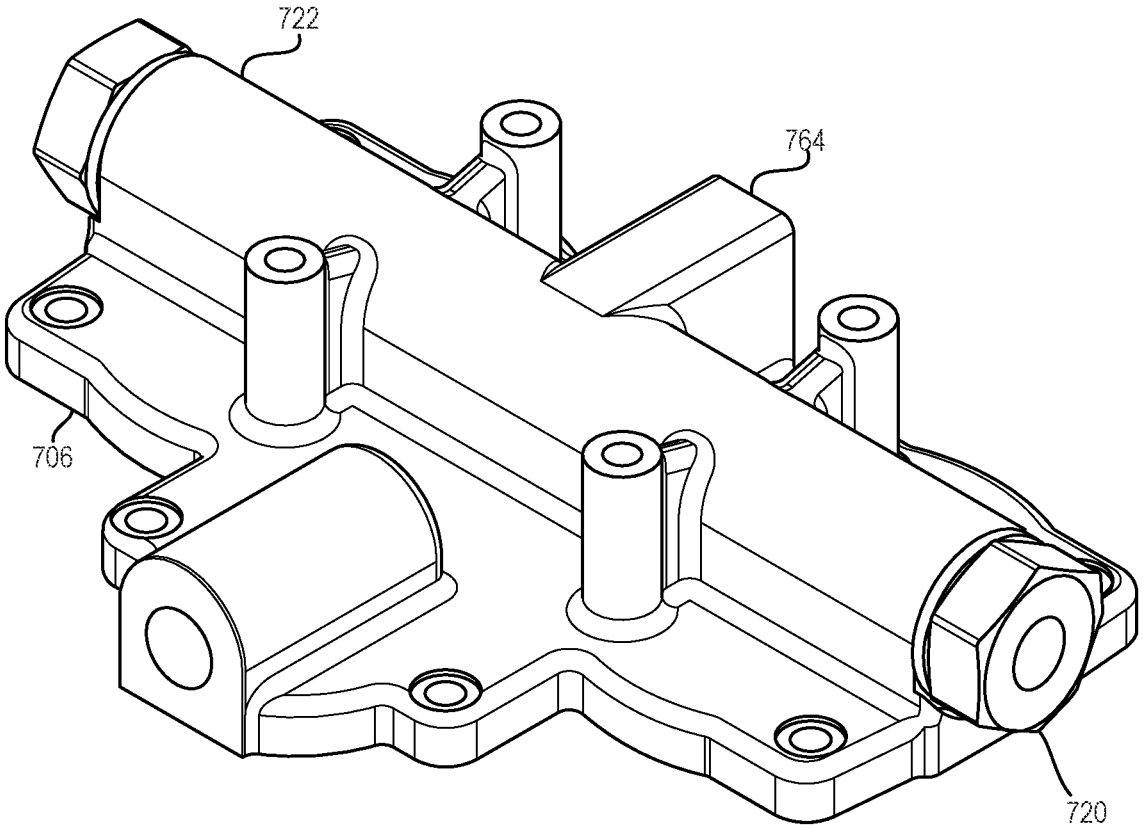
FIG. 13 shows a detailed view of the air dryer head portion.
Figure 14A:
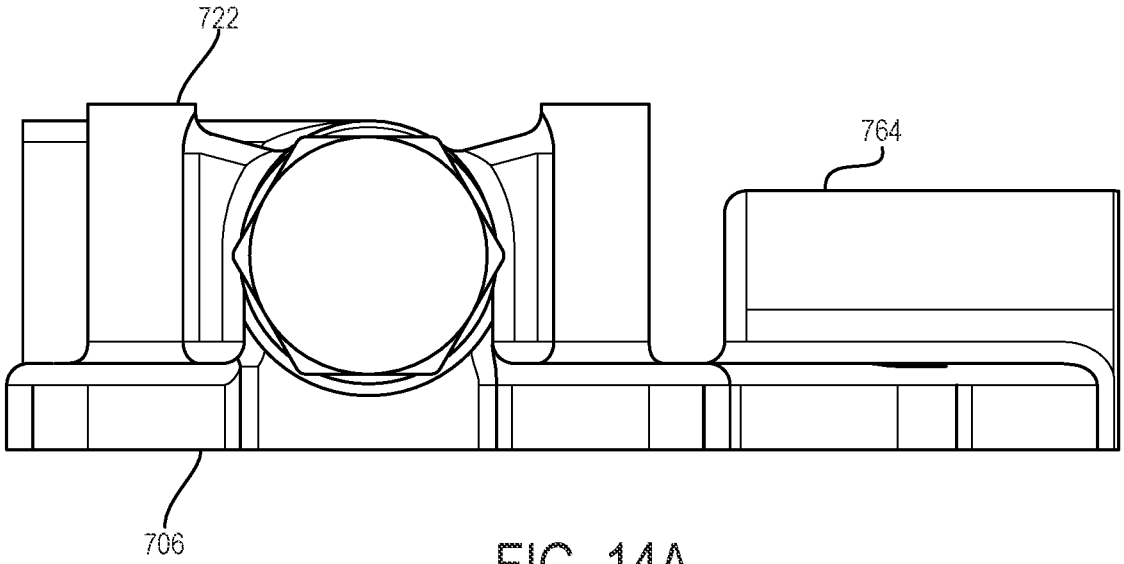
FIGS. 14A and 14B show first and second side-on views of the air dryer head portion.
Figure 14B:
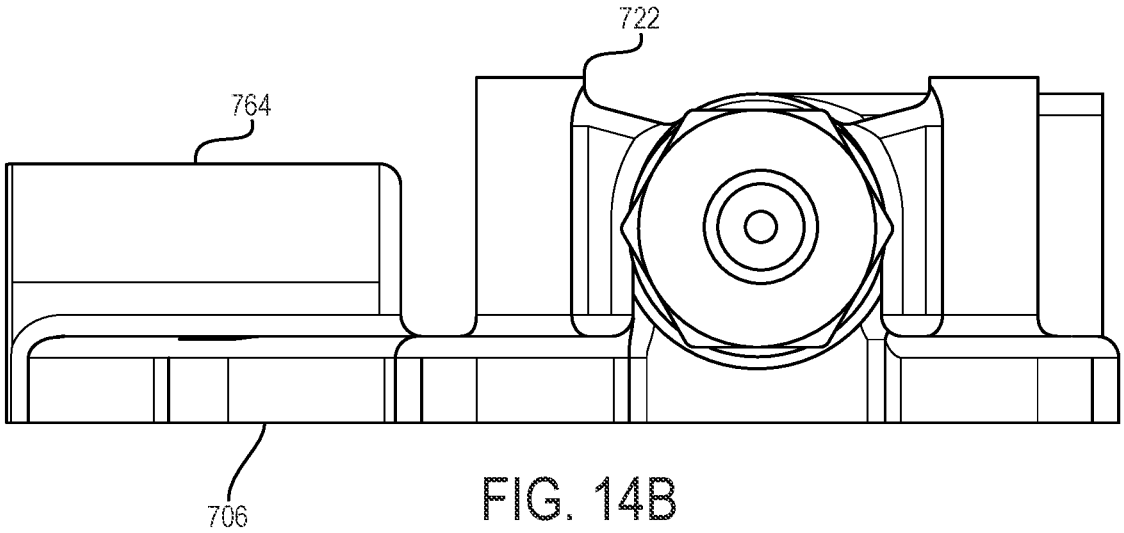

A piston, illustrated in FIGS. 5 and 6, may be rotated via a shaft, such as a crankshaft, arranged in a shaft housing 170. The shaft housing includes a second central axis 194, which is oriented perpendicularly to the first central axis. The shaft housing may extend from the mid-section in a direction parallel to the central axis. The shaft housing may be arranged between the first fan and the second fan, which may further reduce a packaging size of the air compressor system relative to other orientations of the shaft housing. A length of the shaft housing, measured along the x-axis, may be shorter than a length of a combination of the first stage, the mid-section, and the second stage. In one example, the shaft housing, the mid-section, the first stage, and the second stage are manufactured as one piece. Additionally or alternatively, the shaft housing may be manufactured separately from the mid-section, the first stage, and the second stage, wherein the shaft housing is physically coupled to the mid-section via welds, screws, fasteners, or the like.

The shaft housing may include bolts 172 that may mount the compressor to a housing or other structure. Additionally or alternatively, the bolts may mount the shaft housing to a compressor mount, which may mount the dryer as shown in FIGS. 7-15B.

Figure 3:
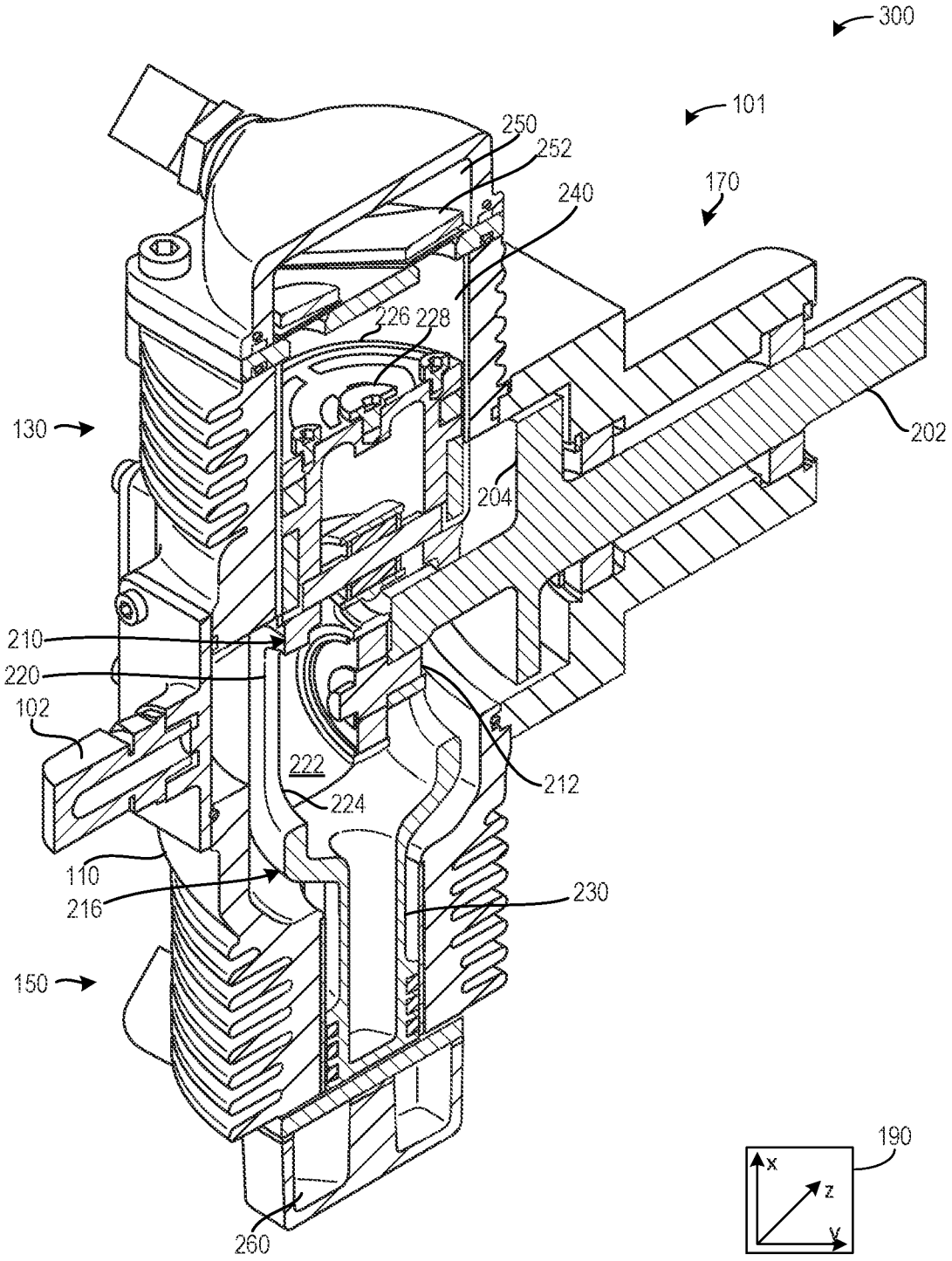

Turning now to FIGS. 2 and 3, they show a first view 200 and a second view 300, respectively. More specifically, the first view illustrates a cross-sectional view taken along the x-z plane of the compressor. The second view illustrates a perspective view of an interior of the compressor. FIGS. 2 and 3 are described in tandem herein.

A piston 210 may be positioned to oscillate within an interior volume 240 of the compressor. The interior volume may span from the mid-section, to each of the first stage and the second stage. The piston may include a first body 220 arranged between a piston crown 226 and a second body 230. The piston includes a connecting rod 212 within the first body physically coupled to a crankshaft 202. The crankshaft includes a flywheel 204 that may increase an efficiency of the crankshaft. That is to say, the flywheel may reduce an amount of energy needed to rotate the crankshaft once a desired rotational speed is met. The crankshaft and the flywheel may be manufactured as a single piece. Additionally or alternatively, the crankshaft and flywheel may be manufactured as separate pieces and coupled to one another. The crankshaft may rotate about the second central axis. The rotation may drive linear motion of the piston along the first central axis via the connecting rod. The crankshaft may rotate about the z-axis and the piston may oscillate along the x-axis.

The first body may include an interior space 222 in which the connecting rod is arranged. The connecting rod may be physically coupled to an interior surface 213 of the piston. The interior surface may define openings while being coupled to other surfaces of a middle portion of the piston. The openings may allow air to flow through the interior space without interruption while allowing the interior space to translate motion applied to the connecting rod to the piston. In one example, the piston is hollow and air may flow through an entirety of the interior space.

The interior space may receive a fluid, such as air, via a first plurality of openings 224. The first plurality of openings is arranged across from one another along the second central axis. In one example, the inlet may admit air into the interior volume of the compressor, wherein the air flows through one of the first plurality of openings and at least partially fills the interior space. Air in the interior space may exit the interior space and flow to the crankshaft arranged in the shaft housing. This may provide a cooling effect, thereby decreasing coolant demands of the crankshaft. Air in the interior space may also exit the interior space via a piston check valve 228 arranged at the piston crown. In one example, air flowing to the interior space is not compressed.

In the position of the piston illustrated in FIGS. 2 and 3, a space is arranged between the piston and the first stage. As such, air may exit the piston check valve and at least partially fill a portion of the interior volume between the piston and the first stage. In one example, there may be no other routes other than the piston check valve fluidly coupling the interior space of the piston to the interior volume. As the piston oscillates and moves toward the first stage, the air may be compressed and enter a first stage chamber 250 through a first stage chamber valve 252. In one example, the first stage chamber valve may move to an open position in response to air in the interior volume exceeding a lower threshold pressure. In one example, this is a first compression stage of the compressor, and air is compressed to a first pressure, which is greater than the lower threshold pressure and less than an upper threshold pressure. The first pressure air is directed to a second stage chamber 260 of the second stage via a passage, such as the passage. Air in the second stage may be compressed to a second pressure, which may be greater than the upper threshold pressure. In one example, the position illustrated is a first position of the piston of the compressor which includes where the piston is pressed against the second stage and oscillates toward the first stage.

The second body 230 of the compressor may compress the first pressure air to the second pressure air. In one example, the second body includes a second diameter which is smaller than a first diameter of the first body. The A transition 216 is arranged between the first body and the second body, wherein a diameter of the transition gradually decreases from the first diameter to the second diameter. The diameter of the interior volume also decreases in the vicinity of the second body and the second stage. Said another way, the diameter of the interior volume corresponds to the diameter of the piston. In one embodiment, the piston may include a wine-bottle shape including a first cylindrical portion, a second cylindrical portion, and a transition between the first and second cylindrical portions. A diameter of the second cylindrical portion may be smaller than a diameter of the first cylindrical portion, allowing the second cylindrical portion to compress air to a pressure above the upper threshold pressure.

As the second body compresses air in the interior volume, the second pressure air is pushed through a second stage chamber check valve 262 and through the outlet. In one example, the outlet includes a check valve that may open in response to a pressure greater than the upper threshold pressure, which is based on the second pressure. In one example, the second pressure is greater than the upper threshold pressure such that air compressed at the second stage overcomes the check valve and flows through the outlet. Compressed air leaving the compressor may enter the dryer.

The crankshaft is rotated via power from a motor about the second central axis. The connecting rod translates rotational energy from the crankshaft into linear energy which forces the piston to travel along the first central axis between the first position and the second position. As the piston moves from the first position to the second position, the air is compressed to the first lower pressure and pushed into the first stage chamber. The first pressure air flows to the second stage chamber and enters a space between the piston and the second stage chamber. The piston moves from the second position, where the piston is adjacent to the first stage chamber, toward the first position. As the piston moves, it compresses the air from the first pressure to a second pressure higher than the first pressure, which reenters the second stage chamber and then exits the compressor.

Figure 4:
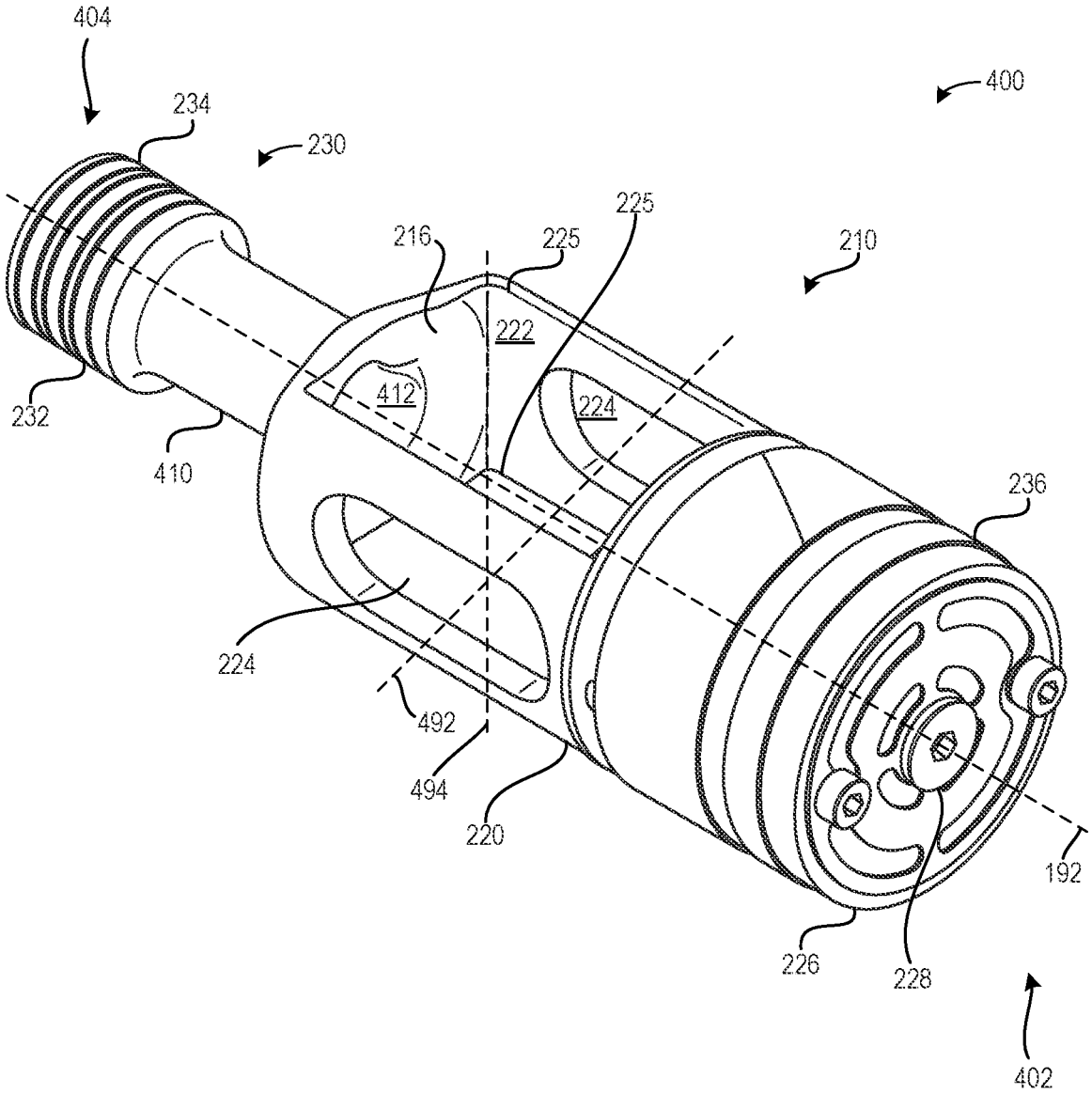
FIG. 4 shows a detailed view of a piston of the air compressor.
Figure 4:
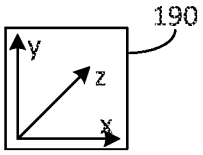

Turning to FIG. 4, it shows a detailed view 400 of the piston. The piston includes the interior volume 222 that may receive gases via at least the plurality of first openings 224. The plurality of first openings are arranged on the first body opposite one another relative to the z-axis. In one example, a first central axis 492 is a common central axis for each of the plurality of first openings.

The first body may include a plurality of second openings 225. The plurality of second openings are arranged on the first body opposite one another relative to the y-axis. In one example, a second central axis 494 is a common central axis of the plurality of second openings 225, wherein the second central axis is normal to the first central axis.

A shape of the plurality of first openings may be oblong. Each first opening of the plurality of first openings may be identical in shape and size. A shape of the plurality of second openings may differ from the shape of the plurality of first openings. In one example, the shape of the plurality of second openings may be rectangular. A size of the plurality of second openings may be greater than a size of the first opening. In some embodiments, the shapes of the plurality of first openings and the plurality of second openings may be adjusted. In some examples, the shapes and/or sizes of the plurality of first openings and the plurality of second openings may be identical to each other. In other examples, the plurality of first openings and the plurality of second openings may differ, and may be selected based at least in part on application specific parameters.

The first body may include a first diameter from the piston crown arranged at a first extreme end 402 of the piston to a piston neck 410 of the second body. That is to say, the first diameter may be a fixed diameter along an entire length of the first body from the first extreme end to the piston neck. The transition gradually changes in diameter from the first diameter of the first body to a second diameter of the piston neck. In one example, the second diameter is a fixed diameter of the piston neck, which extends from the transition to a second body end 232. The second diameter of the piston neck is less than the first diameter of the piston crown.

The second body end includes a third diameter, which is greater than the second diameter and less than the first diameter. In this way, the second body, which includes the piston neck and the second body end includes a largest diameter than is less than a largest diameter of the first body. By shaping the piston in this way, the first body may interact with a first stage of a compressor and compress a gas (e.g., air) to a first pressure, and the second body may interact with a second stage of the compressor and compress the gas to a second pressure, which is greater than the first pressure.

The piston neck includes an internal passage 412 that extends through an entire body of the piston neck, thereby fluidly coupling the interior space of the first body to a second piston body end interior volume. However, the second body end is sealed such that gases in the piston may exit via only the piston check valve, the plurality of first openings, and the plurality of second openings. As such, the piston includes no inlets or additional outlets other than the piston check valve, the plurality of first openings, and the plurality of second openings.

The second body end further includes a plurality of sealing rings 234 arranged on an outer diameter of the second body end. The plurality of sealing rings may be O-rings or other similar type of sealing element. Additionally or alternatively, the first body includes at least one sealing ring 236 arranged on an outer diameter of the first body proximal to the piston crown. The sealing rings may block lubricant from exiting a chamber of the compressor in which the piston is arranged. As such, frictional losses may be reduced.

FIGS. 5 and 6 illustrate a side-on view 500 and a perspective view 600 of the crankshaft, respectively. FIGS. 5 and 6 are described in tandem herein. The crankshaft may have a crank nose end 602 and a flange end 620 arranged on opposite sides of the crankshaft. The crank nose end may couple to a pulley, vibration dampener, or other similar element.

The crankshaft includes a crankshaft midway-section 606. The crankshaft midway-section may include a ramp surface 604 between flange end and the crank nose end. The ramp surface may gradually change a diameter of the crankshaft from the crank nose end to the crankshaft midway-section.

The flywheel may be disposed along the crankshaft midway-section. The flywheel includes a first flywheel portion 612 and a second flywheel portion 614. The first flywheel portion includes a half-circle shape. In one example, the first flywheel portion includes a curved surface intersecting one another at a region over the crankshaft midway-section. A height of the curved surface may increase in an inward direction toward the crankshaft midway-section. More specifically, a flywheel axis 690 may be normal to the second central axis and represent a region of an outer perimeter of the first flywheel portion from which the curved surfaces extend and curve toward the crankshaft midway-section. The curved surfaces curve along the y-axis such that the curved surfaces intersect along a highest region of the crankshaft midway-section relative to the y-axis. In this way, the curved surfaces deviate from the half-circle shape of the flywheel.

The second flywheel portion may have a circular cross sectional profile. The second flywheel portion may be arranged between the first flywheel portion and the flange end. The second flywheel portion includes a circular cross-sectional shape taken along a y-z plane. In one example, the first flywheel portion and the second flywheel portion are a single monolithic and seamless piece.

In one example, the crankshaft is a single monolithic and seamless piece. The flywheel may function as a counterweight while the crank nose end and/or the crankshaft midway-section may be press fit into a motor shaft. In one example, only the crank nose end is press fit into the motor shaft. As such, a motor may drive rotation of the crankshaft. The flange end may couple to the piston via a connecting rod or other similar device along the axis. Rotation of the crankshaft is translated into linear motion of the piston in the compressor.

Turning now to FIGS. 7 to 15B, they show an air dryer 701 illustrating embodiments of the invention. The air dryer 701 may remove moisture from a flow of air. For example, the air dryer may dehumidify air leaving the compressor of FIG. 1-4. The air dryer includes an inlet 702 and an outlet 704. The inlet may receive and direct air to an interior volume of the air dryer. In one example, the inlet receives air from the compressor of FIGS. 1-4, wherein the air flowing through the inlet includes a first moisture content. After flowing through various portions of the interior volume of the air dryer, the air may exit the air drying via the outlet, and the air exits with a second moisture content that is lower than the first moisture content. In one example, the second moisture content is set to a value wherein the air exiting the air dryer may be used to generate an air barrier from ambient conditions.

The air dryer includes a main chamber 710. The chamber is fluidly coupled to the inlet. The air dryer head portion 706 may be physically coupled to an air dryer body 708. The air dryer head portion may be physically coupled to the air dryer body via a plurality of fasteners 707, which may include bolts, screws, or the like. The inlet may be fluidly coupled to the chamber, wherein the chamber includes a plurality of chambers.

The main chamber includes a first chamber 712, a second chamber 714, and a third chamber 716. The first chamber and the second chamber may be drying chambers including a desiccant or other similar material that may separate water from air. The third chamber is arranged between the first chamber and the second chamber. The third chamber may include a diameter smaller than a diameter of the first chamber and the second chamber. In one example, the first chamber and the second chamber are substantially identical in size and shape.

Air from the inlet may flow to the third chamber, where desiccant in the third chamber separates water from the compressed air. The water may be directed to a water outlet valve 718 to mitigate an amount of water directed to either the first chamber or the second chamber. The dried compressed air is directed to at least one of the first chamber or the second chamber. In one example, the dried compressed air is directed to only one of the first chamber or the second chamber. After flowing through only one of the first chamber or the second chamber, the dried air is directed toward a shuttle valve 722 arranged in the air dryer head portion, wherein a majority of the dried air may be directed to the outlet to exit the air drying system. A minority of the dried air may be directed to one of the first chamber or the second chamber to regenerate the chamber.

In one example, dried air from the third chamber flows directly to the first chamber during a first drying cycle. The dried air from the third chamber is further dried in the first chamber, before flowing to the shuttle valve in a first direction. Air in the shuttle valve may be directed to the outlet to be used in an air curtain. Air in the shuttle valve may also be used to regenerate desiccant of a chamber. In one example, during the first drying cycle, dried air in the shuttle valve is directed toward the second chamber, wherein the dried air flows in a second direction, opposite the first direction, and dries desiccant therein. As such, water is removed and the desiccant is regenerated to a state that may absorb more water. During a second drying cycle, subsequent the first drying cycle, dried air from the third chamber is directed to the second chamber. In this way, the air dryer may alternate use of the first chamber and the second chamber in order to enhance drying of the compressed air. Dried air from the second chamber may flow to the shuttle valve, where the shuttle valve may divide the air flow into two flows. A first flow flows toward the first chamber and a second flow flows toward the outlet. In one example, a volume of the first flow is less than a volume of the second flow. In one example, the first flow is a leak that allows a relatively small amount of dried air to flow to the first chamber while the second flow exits the air dryer and flows to a bulk head. The first flow may regenerate the first chamber so that the first chamber is returned to a less wet condition and able to dry air during a subsequent drying cycle (e.g., a third drying cycle following the second drying cycle).

Figure 15A:
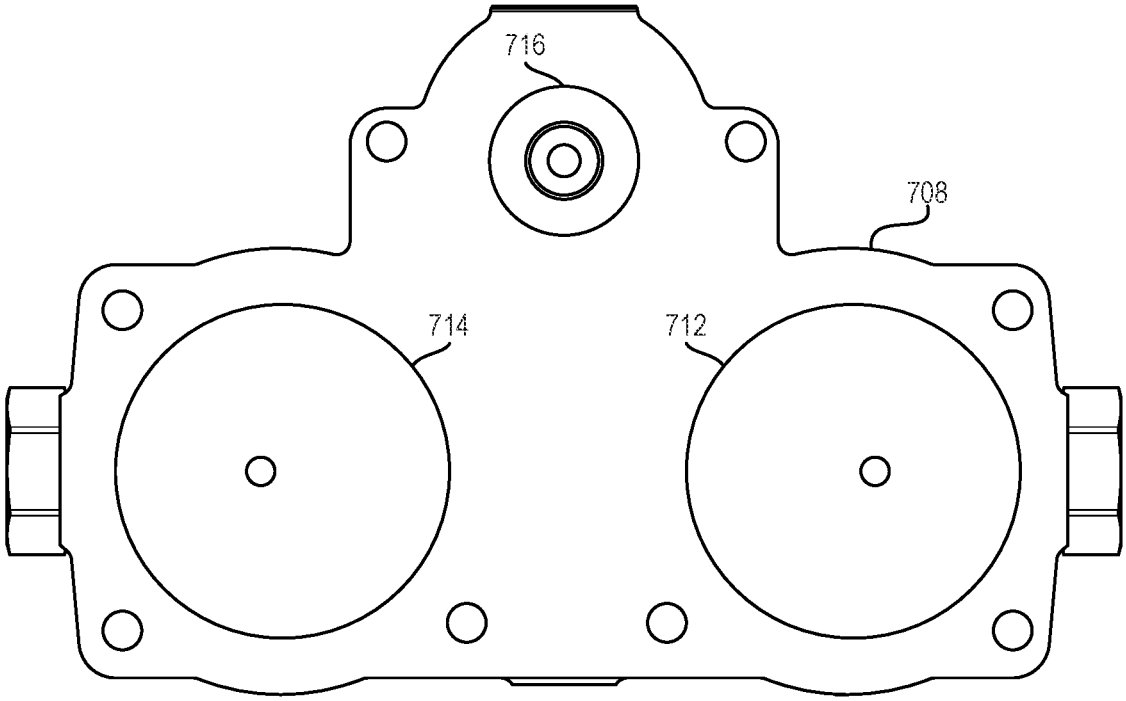
FIG. 15A shows an internal view of chambers of the air dryer.
Figure 15B:
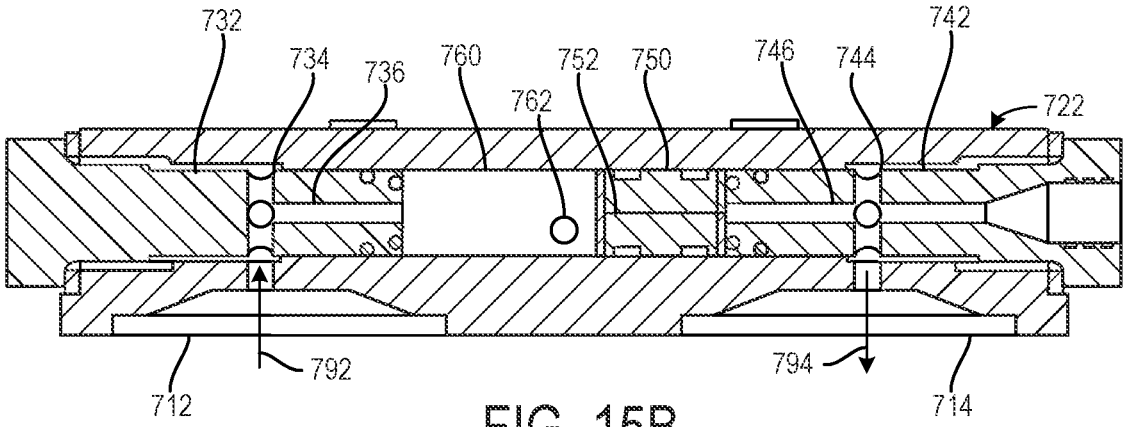
FIG. 15B shows an internal view of the air dryer head portion including a shuttle valve.

FIG. 15B illustrates a more detailed view of the shuttle valve. The shuttle valve includes a first portion 732 fluidly coupled to the first chamber and a second portion 742 fluidly coupled to the second chamber. The first portion includes a first portion connecting passage 734 and a first portion outlet 736. The second portion 742 includes a second portion connecting passage 744 and a second portion outlet 746.

The shuttle valve further includes a shuttle 750 which is moveable through an interior volume 760 of the shuttle valve. The shuttle is positioned in a first position in the embodiment of FIG. 15B. When in the first position, the shuttle may flow a small amount of air to the second chamber 714 to regenerate a desiccant arranged therein. The air flow to the second chamber may be a result of compressed dried air flowing from the first chamber, through the first portion connecting passage, through the first portion outlet, and into the interior volume. The shuttle includes a bleed line 752 that may flow some of the dried compressed air from the first chamber to the second chamber. Directional Arrows 792 and 794 illustrate a direction of air flow through the first and second chambers during the drying process. The arrow 792 illustrates dried air flow from the first chamber to the first portion flowing in a first direction. The arrow 794 illustrates dried air flow from the second portion to the second chamber flowing in a second direction, wherein the second direction is opposite the first direction. The dried air used to regenerate the second chamber is not mixed with dried air from the first chamber to perform a vehicle function. As such, the dried compressed air in the interior volume from the first chamber exits the interior volume via a shuttle valve outlet 762. The shuttle valve outlet flows the dried air to a connecting channel bridging a gap between the shuttle valve and the outlet.

The compressor and the air dryer may achieve a technical effect of a compact air compression system. The system may achieve high pressure in combination with low humidity relative to ambient. The compressor may utilize an interior of a piston for both heat management of the piston and a crankshaft and for flowing air to an interior volume of the air compressor system. The piston may include cylindrical sections with different diameters configured to compressor the air to a first pressure at a first side of the air compressor system. The air pressurized to the first pressure may flow to a second side, wherein a narrower section of the piston may compressor the air to a second pressure, greater than the first pressure. The air pressurized to the second pressure may flow to the air dryer, where a moisture content of the air may be reduced.

The disclosure provides support for air compressor system including a housing, a piston having a connecting rod arranged in the housing, and a crankshaft arranged in the housing, the crankshaft coupled to the connecting rod of the piston; and the crankshaft is configured to force the piston to oscillate from a first end of the housing to a second end, the piston pressurizing air in the housing to a first pressure at the first end and to a second pressure at the second end, the second pressure greater than the first. A first example of the system further includes where the piston comprises a first portion, a second portion and a transition therebetween, wherein the first portion is a first cylinder comprising a first diameter and the second portion is a second cylinder comprising a second diameter different than the first diameter. A second example of the system, optionally including the first example, further includes where the first portion compresses air at the first end and the second portion compresses air at the second end. A third example of the system, optionally including one or more of the previous examples, further includes where the piston is hollow and comprises an interior space into which air entering the air compressor system flows. A fourth example of the system, optionally including one or more of the previous examples, further includes where the piston comprises a plurality of openings through which air flows to one of the first end or the crankshaft. A fifth example of the system, optionally including one or more of the previous examples, further includes where the crankshaft comprises a flywheel, and the flywheel comprises a first flywheel portion and a second flywheel portion, the second flywheel portion larger than the first flywheel portion. A sixth example of the system, optionally including one or more of the previous examples, further includes where the first flywheel portion comprises a contour extending around a crankshaft midway-section. A seventh example of the system, optionally including one or more of the previous examples, further includes where the connecting rod is arranged in an interior space and along a mid-section of the piston.

The disclosure further provides support for air compressor system including a compressor and a dryer, and the compressor is configured to flow pressurized air to the dryer, and the compressor comprises a piston that is configured to oscillate between a first stage and a second stage of the compressor, and a crankshaft is physically coupled to a connecting rod arranged in an interior space of the piston, and the interior space is configured to receive air from an interior volume of the compressor via a plurality of openings. A first example of the system further includes where the crankshaft comprises a flywheel, and the flywheel comprises a first flywheel portion and a second flywheel portion, and the first flywheel portion comprises a half circle shape and the second flywheel portion comprises a full circle shape. A second example of the system, optionally including the first example, further includes where a central axis of the crankshaft is normal to an axis about which the piston oscillates, and the second flywheel portion is closer to the piston than the first flywheel portion. A third example of the system, optionally including one or more of the previous examples, further includes where the piston is symmetric and comprises a first piston body and a second piston body, and the first piston body comprises a diameter larger than a diameter of the second piston body, and the piston comprises a piston transition body arranged between the first piston body and the second piston body. A fourth example of the system, optionally including one or more of the previous examples, further includes where the interior space extends through the first piston body, the piston transition body, and the second piston body, and air in the interior space exits the interior space via a check valve arranged in a piston crown in the first piston body. A fifth example of the system, optionally including one or more of the previous examples, further includes where the first piston body comprises the plurality of openings, and the plurality of openings comprises a plurality of first openings and a plurality of second openings, and the plurality of second openings are shaped differently than the plurality of first openings. A sixth example of the system, optionally including one or more of the previous examples, further includes where the compressor comprises a plurality of fins arranged on a compressor housing, and the plurality of fins is arranged adjacent to the first stage and the second stage.

The disclosure further provides support for a system including an air system configured to pressurize and dry air flowing therethrough, and the air system comprises a compressor with a piston, and the piston expels air through a check valve arranged in a piston crown to a first stage of the compressor, and a second stage of the compressor is fluidly coupled to the first stage via a passage, the second stage of the compressor configured to flow compressed air to an air dryer comprising a shuttle valve integrally arranged therein. A first example of the system further includes where the crankshaft comprises a flange end that couples to a connecting rod arranged in an interior space of the piston. A second example of the system, optionally including the first example, further includes where the piston crown is arranged at a first extreme end of the piston, and the first extreme end comprises a first diameter larger than a second diameter of a second extreme end of the piston, and the second extreme end is sealed from the second stage of the compressor. A third example of the system, optionally including one or more of the previous examples, further includes where the piston oscillates between the first stage and the second stage along a first axis via a crankshaft, and the crankshaft rotates about a second axis which is normal to the first axis, the crankshaft comprising a flywheel, and the flywheel comprises a first portion in face-sharing contact with a second portion, and the first portion comprises a half-circle shape and the second portion comprises a full circle shape. A fourth example of the system, optionally including one or more of the previous examples, further includes where the crankshaft is arranged perpendicularly to the piston and extends in a direction adjacent to fans of the first stage and the second stage.

The depictions in the figures show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. One or more components referred to as being "substantially similar and/or identical" differ from one another according to manufacturing tolerances (e.g., within 1-5% deviation). An element or step recited in the singular and proceeded with the word "a" or "an" do not exclude plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. An air compressor system, comprising:

a housing;

a piston having a connecting rod arranged in the housing, wherein the piston is hollow and comprises an interior space within the piston into which air entering the air compressor system flows, wherein the interior space extends through a first portion, a transition portion, and a second portion of the piston, and wherein air exits the interior space through a piston crown of the first portion; and a crankshaft arranged in the housing, the crankshaft coupled to the connecting rod of the piston, and the crankshaft is configured to force the piston to oscillate from a first end of the housing to a second end, the piston pressurizing air in the housing to a first pressure at the first end and to a second pressure at the second end, the second pressure greater than the first.

2. The air compressor system of claim 1, wherein the transition portion is between the first portion and the second portion of the piston, and wherein the first portion is a first cylinder comprising a first diameter and the second portion is a second cylinder comprising a second diameter different than the first diameter.

3. The air compressor system of claim 1, wherein the first portion compresses air at the first end and the second portion compresses air at the second end.

4. The air compressor system of claim 1, wherein the piston comprises a plurality of openings through which air flows to one of the first end or the crankshaft.

5. The air compressor system of claim 1, wherein the crankshaft comprises a flywheel, and the flywheel comprises a first flywheel portion and a second flywheel portion, the second flywheel portion larger than the first flywheel portion.

6. The air compressor system of claim 5, wherein the first flywheel portion comprises a contour extending around a crankshaft midway-section.

7. The air compressor system of claim 1, wherein the connecting rod is arranged in the interior space and along a mid-section of the piston.

8. An air compressor system, comprising:

a compressor and a dryer, and the compressor is configured to flow pressurized air to the dryer, and the compressor comprises a piston that is configured to oscillate between a first stage and a second stage of the compressor, and a crankshaft is physically coupled to a connecting rod arranged in an interior space of the piston, and the interior space is configured to receive air from an interior volume of the compressor via a plurality of openings, wherein the interior space extends through a first piston body, a piston transition body, and a second piston body, and air in the interior space exits the interior space via a check valve arranged in a piston crown in the first piston body.

9. The air compressor system of claim 8, wherein the crankshaft comprises a flywheel, and the flywheel comprises a first flywheel portion and a second flywheel portion, and the first flywheel portion comprises a half circle shape and the second flywheel portion comprises a full circle shape.

10. The air compressor system of claim 9, wherein a central axis of the crankshaft is normal to an axis about which the piston oscillates, and the second flywheel portion is closer to the piston than the first flywheel portion.

11. The air compressor system of claim 8, wherein the piston is symmetric, wherein the first piston body comprises a diameter larger than a diameter of the second piston body, and wherein the piston transition body is arranged between the first piston body and the second piston body.

12. The air compressor system of claim 11, wherein the first piston body comprises the plurality of openings, and the plurality of openings comprises a plurality of first openings and a plurality of second openings, and the plurality of second openings are shaped differently than the plurality of first openings.

13. The air compressor system of claim 8, wherein the compressor comprises a plurality of fins arranged on a compressor housing, and the plurality of fins is arranged adjacent to the first stage and the second stage.

14. A system, comprising:

an air system configured to pressurize and dry air flowing therethrough, and the air system comprises a compressor with a piston, and the piston comprises an interior space that receives air flowing into the compressor and expels air from the interior space within the piston through a check valve arranged in a piston crown to a first stage of the compressor, and a second stage of the compressor is fluidly coupled to the first stage via a passage, the second stage of the compressor configured to flow compressed air to an air dryer comprising a shuttle valve integrally arranged therein;

wherein the interior space extends through a first portion, a transition portion, and a second portion of the piston.

15. The system of claim 14, wherein the compressor comprises the connecting rod coupled to a crankshaft, and the crankshaft comprises a flange end that couples to a connecting rod arranged in the interior space of the piston.

16. The system of claim 14, wherein the piston crown is arranged at a first extreme end of the first portion of the piston, and the first extreme end comprises a first diameter larger than a second diameter of a second extreme end of the second portion of the piston.

17. The system of claim 14, wherein the piston oscillates between the first stage and the second stage along a first axis via a crankshaft, and the crankshaft rotates about a second axis which is normal to the first axis, the crankshaft comprising a flywheel, and the flywheel comprises a first flywheel portion in face-sharing contact with a second flywheel portion, and the first flywheel portion comprises a half-circle shape and the second flywheel portion comprises a full circle shape.

18. The system of claim 17, wherein the crankshaft is arranged perpendicularly to the piston and extends in a direction adjacent to a plurality of cooling fins of the first stage and the second stage.

* * * * *